US006971975B2

(12) United States Patent
Croft

(10) Patent No.: US 6,971,975 B2
(45) **Date of Patent: *Dec. 6, 2005**

(54) STORAGE UNIT FOR COLLAPSIBLE EXERCISE DEVICE

(76) Inventor: Ellen Croft, 410 Palm Ave., Apt. A1, Carpinteria, CA (US) 93013

( * ) Notice: Subject to any disclaimer, the term of this patent is extended or adjusted under 35 U.S.C. 154(b) by 393 days.

This patent is subject to a terminal disclaimer.

(21) Appl. No.: 10/266,443

(22) Filed: Oct. 7, 2002

(65) Prior Publication Data

US 2004/0067828 A1 Apr. 8, 2004

(51) Int. Cl.[7] ..... A63B 21/00
(52) U.S. Cl. ..... 482/121; 482/122; 482/129
(58) Field of Search ..... 482/137, 136, 482/135, 148, 129; 1/130, 132, 904, 121, 1/129, 112

(56) References Cited

U.S. PATENT DOCUMENTS 2,782,033 A * 2/1957 Ugartechea ..... 482/129
3,874,657 A * 4/1975 Niebojewski ..... 482/104
4,300,761 A * 11/1981 Howard ..... 482/57
4,757,993 A * 7/1988 Rake ..... 482/130
4,844,448 A * 7/1989 Niznik ..... 482/40
6,328,679 B1 * 12/2001 Croft ..... 482/129

* cited by examiner

*Primary Examiner*—Jerome W. Donnelly
(74) *Attorney, Agent, or Firm*—Manatt Phelps & Phillips

(57) ABSTRACT

A compact, low profile, collapsible exercise device with storage base. The device includes a storage case, a rectangular or U-shaped frame pivotally attached to the storage case, a horizontal hinge rod assembly attached to the frame and rotatably mounted on the frame, a resistance bar, a pair of swing arms, each swing arm having a distal end attached to opposing ends of the hinge rod, and proximal ends attached to opposing ends of the resistance bar. The device includes at least two springs, each spring having a proximal end and a distal end. The distal ends of the springs are releasably attached to spring connectors on the frame. The proximal ends of the springs are attached to the respective swing arms near the proximal ends thereof. In use, an exerciser positions a part of his/her body, such as the hands, in contact with the resistance bar and applies a force sufficient to extend the springs. When the exerciser releases the force, the spring restores to its non-extended length. The exerciser repeats the cycle until the targeted body part(s) is sufficiently exercised. The various possible attachment points for the distal ends of the springs enable the device to be used for exercising various muscles of the body, including the arms, shoulders, legs, back, chest and abdomen. The exercise device, when collapsed, is housed within the compact, low profile case for storage and transport.

3 Claims, 6 Drawing Sheets

STORAGE UNIT FOR COLLAPSIBLE EXERCISE DEVICE

BACKGROUND OF THE INVENTION

1. Field of the Invention

The present invention relates to exercise equipment, and more particularly, to a collapsible resistance device for personal exercise.

2. Related Art

Wall-mountable resistance-type exercise devices are well known in the art. Various embodiments of such devices are disclosed, for example, in U.S. Pat. Nos. 5,468,205, 5,431,617, 4,402,504 and 5,385,525. Little, in U.S. Pat. No. 5,626,546, the contents of which patent is incorporated herein by reference thereto, provides a review of such prior art devices and discloses a wall-mountable resistance-type exercise device that overcomes many of the limitations present in prior art devices. Little's device has a matched pair of slotted rails adapted to be vertically mounted on a vertical surface. A matched pair of swing arms are rotatably mounted on slidably adjustable universal blocks disposed within the slots. The opposing ends of the swing arms are attached to a resistance bar and an elastic resistance member. The points of attachment of both the swing arms and the elastic resistance members to the slotted rails are incrementally adjustable along substantially the entire length of the slotted rails. A disadvantage of the device is the large number of parts required to make the device operational.

Croft, in U.S. Pat. No. 6,328,679, the content of which patent is incorporated herein by reference thereto, discloses a compact, low profile, wall-mountable exercise device ("the Croft device" or, in the alternative, "a Croft-type device"). The Croft device includes a modular, wall-mountable rectangular frame, a horizontal hinge rod assembly attached to the frame and rotatably mounted on the frame, a resistance bar, a pair of swing arms, each swing arm having a distal end attached to opposing ends of the hinge rod, and proximal ends attached to opposing ends of the resistance bar. The Croft device includes at least two springs, each spring having a proximal end and a distal end. The distal ends of the springs are releasably attached to spring connectors on the frame. The proximal ends of the springs are attached to the respective swing arms near the proximal ends thereof. In use, an exerciser positions a part of his/her body, such as the hands, in contact with the resistance bar and applies a force sufficient to extend the springs. When the exerciser releases the force, the spring restores to its non-extended length. The exerciser repeats the cycle until the targeted body part(s) is sufficiently exercised. The various possible attachment points for the distal ends of the springs enable the device to be used for exercising various muscles of the body, including the arms, shoulders, legs, back, chest and abdomen. The device is not readily transportable and requires a permanent wall mount which may not be aesthetically pleasing in a home setting. There is, therefore, a need for a versatile resistance-type exercise device that is quickly and easily assembled and may be collapsed when not in use for convenient storage and/or transport.

SUMMARY

A first object of the present invention is to provide a collapsible, resistance-type exercise device that can be rapidly assembled and installed with a minimum of parts.

It is a further object of the present invention is to provide a collapsible, resistance-type exercise device that can be used by an exerciser in either a standing, sitting or supine position.

It is yet a further object of the invention to provide a collapsible resistance-type exercise device that employs springs as a resistance element.

It is still a further object of the invention to provide an exercise device meeting the above objectives that can be collapsed and stored within a compact, low-profile container that is integral with the device and serves to house the device when not in use.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
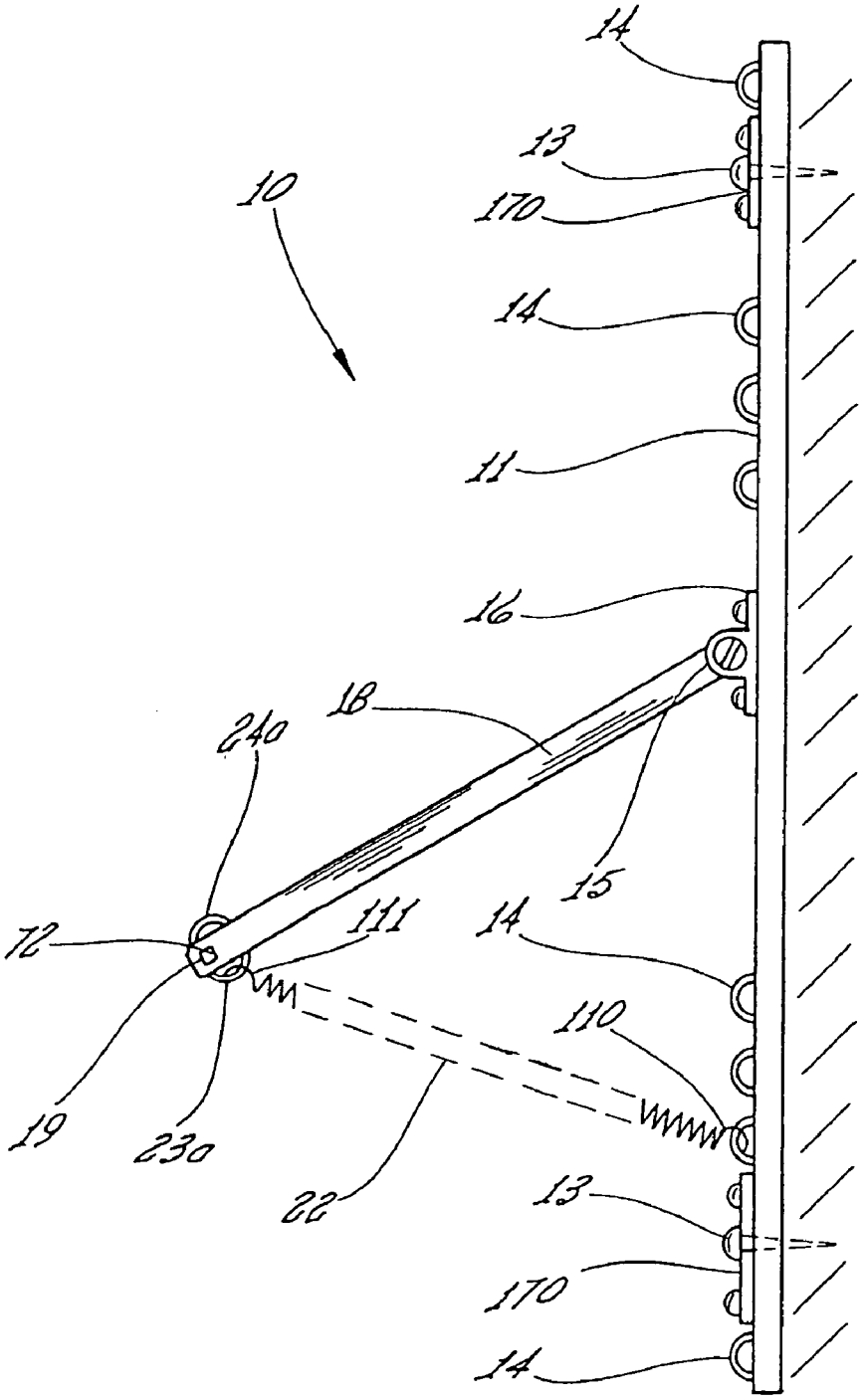
FIG. 1 is a side view of a wall-mounted exercise device.
Figure 2:
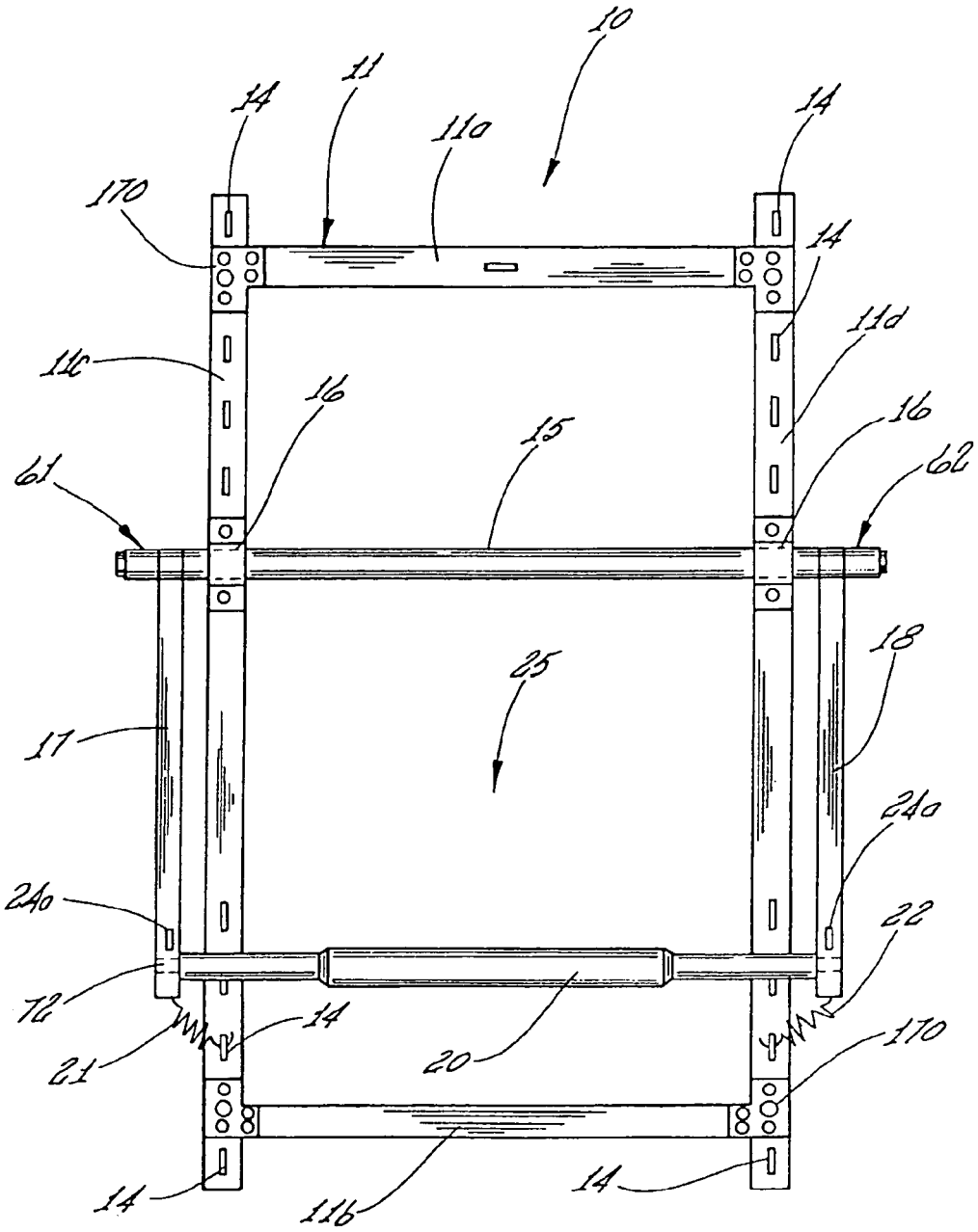
FIG. 2 is a front view of the wall-mounted exercise device of FIG. 1 with the springs removed.
Figure 6:
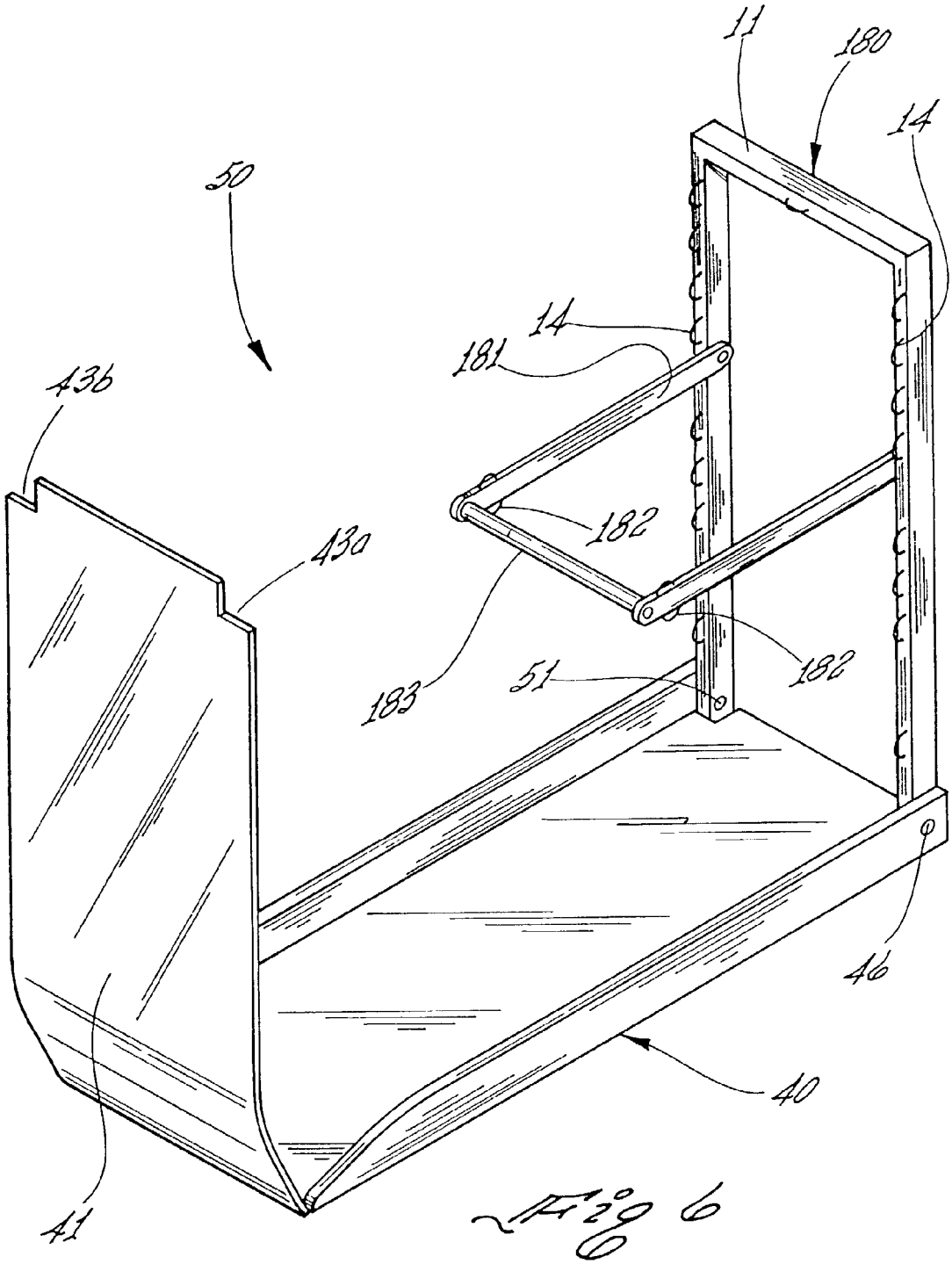
FIG. 6 is a perspective view of a transportable Croft-type exercise device of FIG. 5 with the frame of the exercise device elevated in preparation for use.

Turning first to FIGS. 1 and 2, a wall-mountable exercise device (hereinafter referred to as "the Croft device"), disclosed in U.S. Pat. No. 6,328,679 to the present inventor, is generally indicated at numeral 10. The Croft device 10 includes a rectangular frame 11 attached to a wall 12 by frame mounting means 13 such as, for example, screws. The frame 11 includes a plurality of spaced spring attachment loops 14 integral therewith. A transversely oriented hinge bar 15 is rotatably attached to the frame by a pair of hinge bar mounting brackets 16 affixed to the frame 11. The hinge bar 15 has left and right ends, labeled 61 and 62 in FIG. 6, extending laterally from the hinge bar mounting brackets 16.

The Croft device 10 includes a left swing arm 17 (not visible in FIG. 1) and a right swing arm 18. A distal end of both swing arms are rotatably attached to the respective left and right ends 61 and 62 of the hinge bar 15. The opposing, proximal ends of the left and right swing arms are non-rotatably attached to left and right ends of a resistance bar 25 which provides a gripping surface for an exerciser's hands. Resistance to motion of the resistance bar is provided by left and right extensible springs 21 (not visible in FIG. 1) and 22. A distal end of the springs include a hook 110 thereon which releasably engages one of the plurality of spring attachment loops 14 on the frame. A hook 111 on the proximal ends of the respective springs releasably engages one of the spring attachment loops 23*a*, 23*b*, 24*a* or 24*b* disposed on the proximal ends of the respective swing arms.

An important feature of the Croft device 10 is that the device 10 has fewer separable parts than previous prior art devices and the modular construction permits shipping the device as a kit that is easily assembled. The frame 11 comprises an upper horizontal member 11*a*, a lower horizontal member 11*b*, a left vertical member 11*c* and a right vertical member 11*d*. The four members comprising the frame preferably have mitered corners and are affixed to one another by frame attachment plates 170 to form a rectangle as shown in FIG. 2. The overall dimensions of the frame 11 are 47 inches high and 18.5 inches wide. The four members comprising the frame and the four frame attachment plates are most preferably aluminum. A plurality of spring attachment loops 14 are disposed along the length of the vertical members 11*c* and 11*d* and spaced from one another by a distance of about 3 inches. The spring attachment loops 14 are integral with the frame 11 and are made by die punching the wall of the vertical members to cut two slots and stretching the material between the slots outwardly to form a loop.

In operation, an exerciser places a targeted portion of the body in contact with the resistance bar and exerts a force on the resistance bar sufficient to move the resistance bar thereby extending the spring against a restoring force. The force required to displace the resistance bar and extend the spring is substantially constant over the range of motion. The resistance bar is then allowed to return to its initial position and the motion repeated until the targeted body portion is sufficiently exercised. The selection of spring attachment hooks 14 on the frame that are available to the exerciser for anchoring the distal hook 110 of the spring makes it possible to exercise a variety of muscles within the body.

Figure 3:
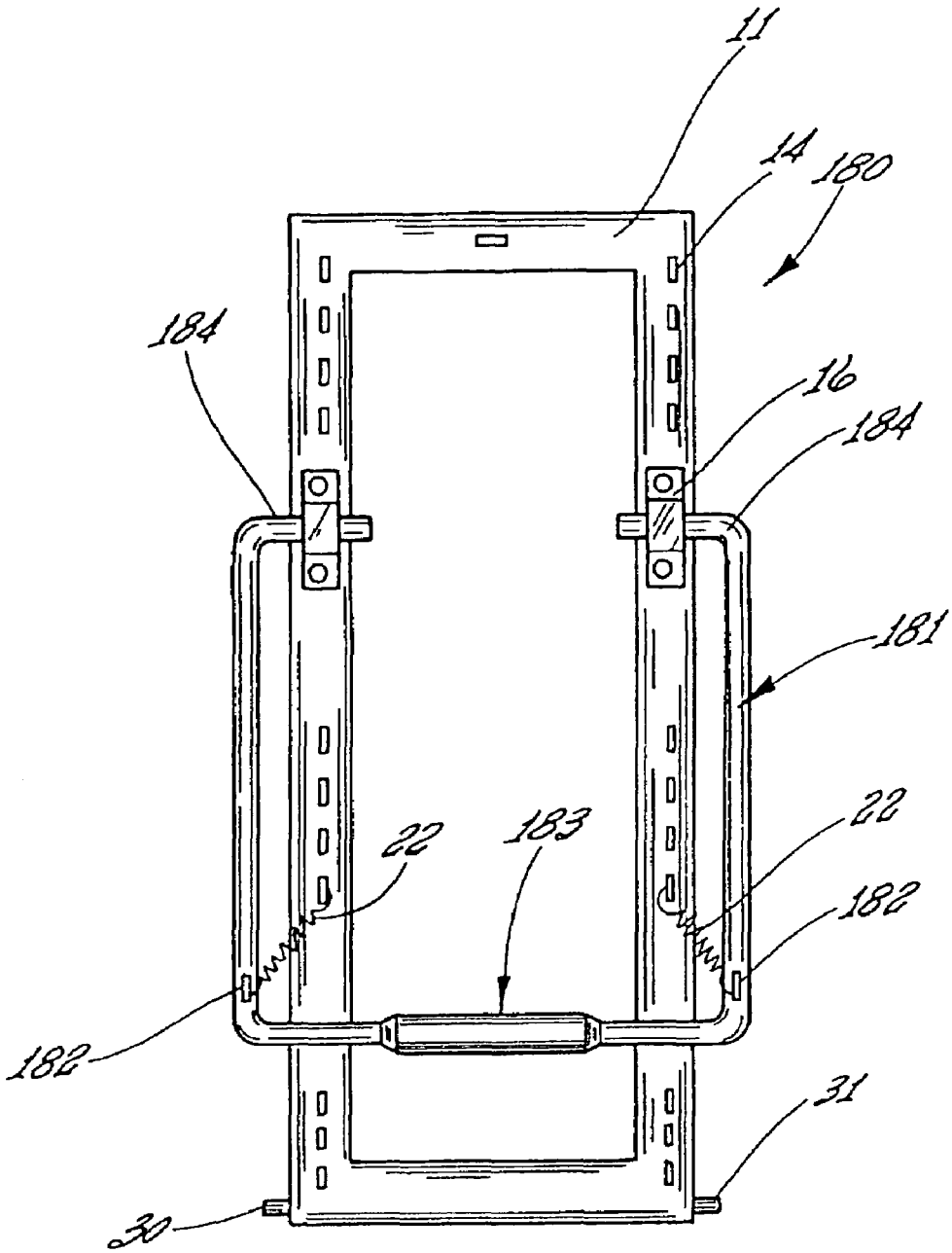
FIG. 3 is a front view of a second embodiment of the Croft device modified to provide pivotal attachment means for the pivotal attachment of the frame to a storage case.

A further embodiment of a wall-mountable Croft device is shown at numeral 180 in FIG. 3. In the embodiment 180, the frame 111 is of unitary construction, wall-mountable and is preferably made of ⅛–¼ inch aluminum plate or from four extruded aluminum members joined to form a rectangular frame by welding or the like. The hinge bar, swing arms and resistance bar are incorporated into a single unitary, substantially U-shaped resistance member 181 that is rotatably attached to the frame 11 at two distal ends 184. The unitary resistance member 181, which has at least two spring attachment loops 182 integral therewith adjacent a resistance bar portion 183, is preferably extruded aluminum rod or tubing formed into a U-shape by bending the extruded member around a mandrel to the desired shape. In the embodiment 180, the hinge bar mounting brackets 16 preferably include roller bearings press-fitted into the bore 161 to reduce wear on the moving surfaces. Embodiment 180 has six separable parts: a unitary frame 11, a unitary resistance member 181, two hinge bar mounting brackets 16 and two springs 22.

Figure 4:
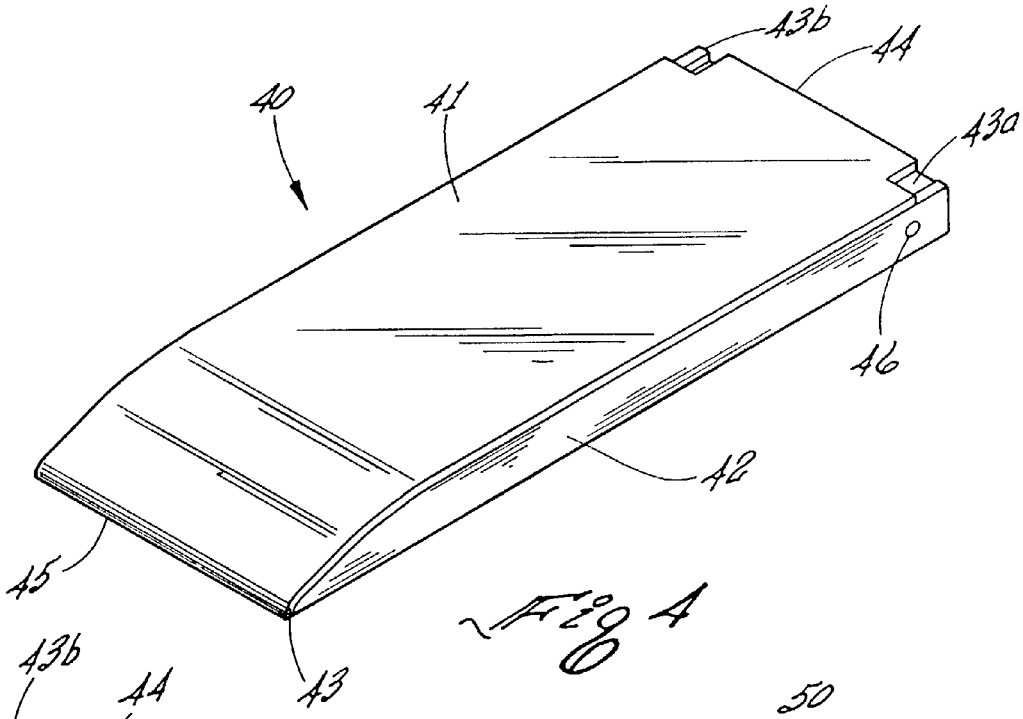
FIG. 4 is a perspective view of a storage case adapted for pivotal attachment to a Croft-type exercise device as shown in FIGS. 1–3.
Figure 7:
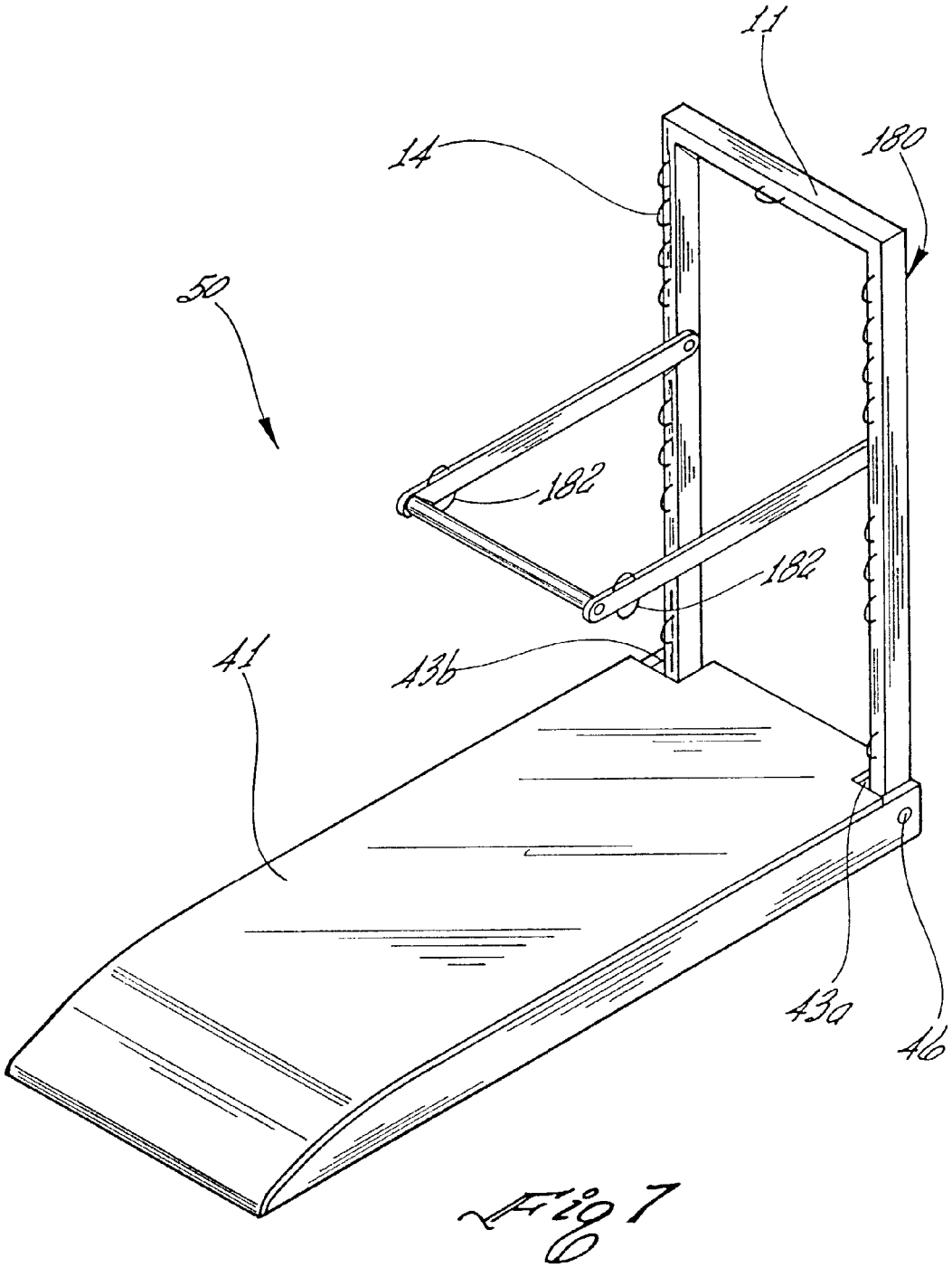
FIG. 7 is a perspective view of the transportable Croft-type exercise device in accordance with FIG. 6 with the lid of the storage case closed in preparation for use.

While wall-mountable Croft devices may be suitable for many installations, it may be desirable to transport the device such as, for example, in a vehicle, for use while traveling. The present invention discloses an exercise device comprising a storage case adapted for pivotal attachment to a modified frame 11 of a Croft device such as, for example, the embodiment 180 of the Croft device shown in FIG. 3. The storage case, indicated in perspective view at numeral 40 in FIG. 4, is integral with the Croft device 180. The storage case 40 provides stable support for the Croft device, obviates the need for wall-mounting the device and provides a compact, low-profile means for storing and transporting a Croft device when not in use. The storage case 40 includes a rectangular lid 41 having a fixed end 45 that is pivotally attached to a rectangular base 42 by means of a hinge 43. The lid 41 has a pair of notches 43*a* and 43*b* at a free end 44 thereof that serve to support the frame 11 of the Croft device 180, wherein the frame 11 is modified to provide pivotal attachment means 51 thereon, when the modified frame of the device is erected for use as shown in FIG. 7. The base 42 of the storage case 40 includes a pair of cylindrical holes 46 dimensioned to receive pivotal attachment means 30 and 31 on the frame 11.

Figure 5:
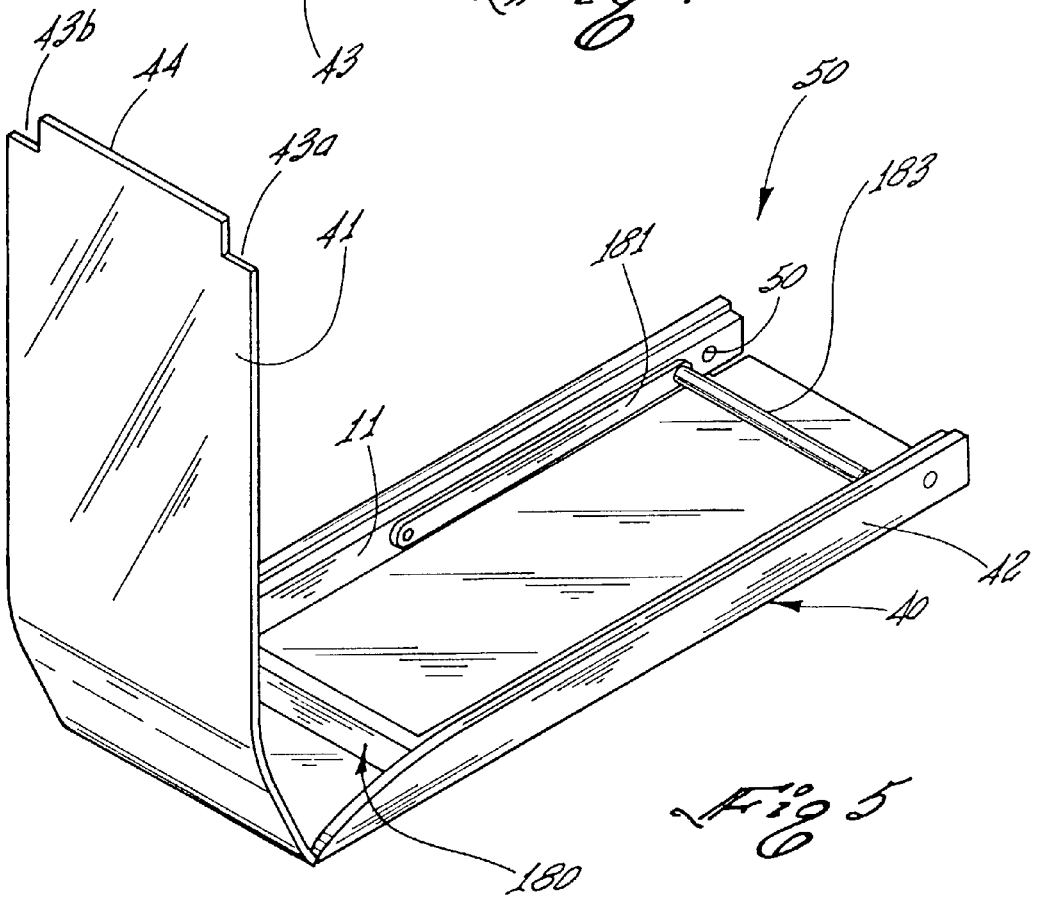
FIG. 5 is a perspective view of a transportable Croft-type exercise device in accordance with a preferred embodiment of the present invention with the lid of the storage case open to reveal the exercise device housed within the storage case.

With reference now to FIG. 5, an exercise apparatus comprising a Croft device 180 pivotally attached to a storage case 40 is indicated in perspective view at numeral 50. The lid 41 of the storage case is shown opened to expose the Croft device 180 housed therewithin. The frame 11 of the Croft device 180 is pivotally attached to the storage case 40 by pivotal attachment means 51. The pivotal attachment means is preferably a pair of cylindrical axles 30 and 31 (FIG. 3) extending outwardly from the base of the frame to rotate within cylindrical recesses or holes 46 in the rectangular base 42 of the storage case 40. The frame, which may be U-shaped inasmuch as the lower horizontal member 11*b* of the prior art Croft device is not required, is erected by lifting the lid 41, rotating the frame upwardly from the confines of the storage case as shown in perspective view in FIG. 6 and closing the lid as shown in FIG. 7. When the frame is erected and the lid 41 closed, the notches 43*a* and 43*b* on the lid 41 fit snugly against the frame 11 to prevent the frame from collapsing into the storage case 40 when the device 50 is being used. Assembly includes the attachment of a pair of springs 22 (not shown in FIGS. 4–7) to the appropriate spring attachment loops 14 on the frame 11 and loops 182 on the swing arms 181 of the device to provide the desired resistance in the manner discussed above in the description of the assembly and operation of the wall-mounted Croft devices 10 and 180. The exercise device 40 of the present invention is readily stored when not in use and easily transported.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A resistance-type exercise device comprising:

(a) a frame having an upper horizontal member and left and right vertical members attached to said upper horizontal member;

(b) a plurality of loops integral with said vertical members of said frame and spaced from each other by an interloop distance;

(c) a left hinge bar mounting bracket integral with said left vertical member of said frame;

(d) a right hinge bar mounting bracket integral with said right vertical member of said frame;

(e) a hinge bar having a left end rotatably attached to said left vertical member by said left hinge bar mounting bracket and a right end rotatably attached to said right vertical member by said right hinge bar mounting bracket;

(f) a left swing arm having a distal end rotatably attached to said left end of said hinge bar and a proximal end with at least one spring attachment loop integral therewith and disposed at said proximal end;

(g) a right swing arm having a distal end rotatably attached to said right end of said hinge bar and a proximal end with at least one spring attachment loop integral therewith and disposed adjacent said proximal end;

(h) a resistance bar having a left end attached to said proximal end of said left swing arm, and a right end attached to said proximal end of said right swing arm;

(i) two substantially identical springs, each spring having a proximal end and a distal end with hooks thereon, said hooks being operable for releasably engaging said spring attachment loops on said frame and on said swing arms; and (j) a storage case dimensioned to receive said frame therewithin, said storage case having a lid and a base portion having pivotal frame mounting means thereon operable for pivotally attaching said left and right vertical members of said frame to said base portion of said storage case.

2. A low-profile, wall-mountable resistance-type exercise device comprising:

(a) a pivotally-mountable frame having a plurality of spring attachment loops integral with said frame;

(b) a substantially U-shaped resistance member having unitary construction comprising a proximal resistance bar portion adapted to be gripped by the hands, two distal ends rotatably attached to said frame and a spring attachment loop adjacent each end of said resistance bar portion; and (c) two coil springs having a proximal end attached to said spring attachment loops on said resistance member adjacent said resistance bar portion, and a distal end attached to one of said spring attachment loops on said frame; and (d) a storage case dimensioned to receive said frame therewithin, said storage case having a lid and a base portion having pivotal frame mounting means thereon operable for pivotally attaching said frame to said base portion of said storage case.

3. The exercise device in accordance with claim 2 further comprising two hinge mounting brackets adapted to rotatably attach said two distal ends of said resistance member to said frame.

* * * * *